US008413983B2

(12) United States Patent
Hirano

(10) Patent No.: US 8,413,983 B2
(45) Date of Patent: Apr. 9, 2013

(54) IMAGE FORMING APPARATUS WITH ACCURATE SHEET CONVEYANCE

(75) Inventor: Masatoshi Hirano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/363,153

(22) Filed: Jan. 31, 2012

(65) Prior Publication Data

US 2012/0248689 A1 Oct. 4, 2012

(30) Foreign Application Priority Data

Mar. 31, 2011 (JP) ..... 2011-079086

(51) Int. Cl.
*B65H 7/02* (2006.01)

(52) U.S. Cl.
USPC ..... 271/258.01; 271/265.01; 271/176

(58) Field of Classification Search ..... 271/264, 271/258.01, 265.01, 176
See application file for complete search history.

(56) References Cited

U.S. PATENT DOCUMENTS

| | | | | |
|---|---|---|---|---|
| 7,334,787 | B2 * | 2/2008 | Akiyama et al. | 271/10.02 |
| 7,607,661 | B2 * | 10/2009 | Akiyama et al. | 271/265.01 |
| 7,686,301 | B2 * | 3/2010 | Kakishima | 271/264 |
| 2002/0039119 | A1 | 4/2002 | Igarashi | |
| 2004/0197126 | A1 | 10/2004 | Igarashi | |
| 2006/0221412 | A1 | 10/2006 | Terada | |
| 2011/0064500 | A1 * | 3/2011 | Takahashi | 399/396 |
| 2011/0310168 | A1 * | 12/2011 | Numata | 347/29 |
| 2012/0072015 | A1 * | 3/2012 | Takahashi | 700/229 |
| 2012/0161387 | A1 * | 6/2012 | Horade | 271/225 |

FOREIGN PATENT DOCUMENTS

| | | | |
|---|---|---|---|
| JP | 2000-010635 | A | 1/2000 |
| JP | 2002096512 | A | 4/2002 |
| JP | 2006095811 | A | 4/2006 |
| JP | 2006-306084 | A | 11/2006 |

* cited by examiner

*Primary Examiner* — David H Bollinger
(74) *Attorney, Agent, or Firm* — Baker Botts L.L.P.

(57) ABSTRACT

An image forming apparatus, including: a conveyor mechanism; a motor driver; and a controller for implementing a sheet-conveyance related control by execution of motor control processing in which a control input for a motor is calculated, wherein the controller implements the motor control processing in each sheet conveyance operation such that the control input is repeatedly calculated for conveying the sheet to a target stop position and for keeping the sheet located at the position, and wherein, in the motor control processing, the controller calculates the control input such that, after the sheet has reached the target stop position, the control input is equal to a hold control input required for keeping the sheet located at the position and such that, at a start point of the processing, the control input is not smaller than the hold control input in the processing in a previous sheet conveyance operation.

17 Claims, 10 Drawing Sheets

IMAGE FORMING APPARATUS WITH ACCURATE SHEET CONVEYANCE

CROSS REFERENCE TO RELATED APPLICATION

The present application claims priority from Japanese Patent Application No. 2011-079086, which was filed on Mar. 31, 2011, the disclosure of which is herein incorporated by reference in its entirety.

BACKGROUND OF THE INVENTION

1. Field of the Invention

The present invention relates to an image forming apparatus.

2. Discussion of Related Art

There has been conventionally known an image forming apparatus, such as an inkjet printer, configured to successively or intermittently convey a sheet, such as a paper, by a prescribed amount and to form an image on the sheet by a recording head. In the image forming apparatus, the image is formed on the sheet on the basis of image data corresponding to the image to be printed, by alternately repeating an operation in which the sheet is conveyed and an operation in which the image is formed on the sheet that is at rest. The conveyance of the sheet is attained by rotation of rollers, for instance.

In the image forming apparatus described above, the rollers may receive a force that causes the roller to be rotated in a reverse direction due to an influence of gears or the like and accordingly a force that causes the sheet to be retracted may act on the sheet by the reverse rotation of the rollers. The conventional apparatus deals with such a situation by applying a hold current to a motor even while the sheet is at rest, so as to keep the rest state of the sheet.

SUMMARY OF THE INVENTION

In the conventional technique, there is a possibility that the following problem will be caused. That is, in the conventional technique, a supply current is temporarily decreased when the conveyance of the sheet starts from the state in which the sheet is at rest by the hold current supplied to the motor. Accordingly, the sheet may be retracted before the supply current increases after initiation of the conveyance of the sheet. Where the sheet is retracted as described above, it is impossible to successively or intermittently convey the sheet accurately by the prescribed amount in the image forming apparatus described above, whereby the quality of the image to be formed on the sheet is deteriorated.

It is therefore an object of the present invention to provide an image forming apparatus in which a sheet is prevented from being retracted when conveyance of the sheet is initiated.

The object indicated above may be attained according to a principle of the present invention which provides, an image forming apparatus configured to form an image on a sheet by a sheet conveyance operation in which the sheet is conveyed and an image forming operation in which the image is formed on the sheet that is at rest, the sheet conveyance operation and the image forming operation being repeated alternately a plurality times, comprising:

a conveyor mechanism having a motor and configured to convey the sheet by a driving force of the motor;

a motor driver configured to drive the motor; and a controller configured to implement a control relating to the sheet conveyance operation by execution of motor control processing in which a control input with respect to the motor is calculated and a signal corresponding to the control input is inputted to the motor driver, wherein the controller implements the motor control processing in each sheet conveyance operation such that the control input is repeatedly calculated for permitting the sheet to be conveyed to a target stop position correspond to a current sheet conveyance operation and for keeping the sheet located at the target stop position and such that the signal corresponding to the calculated control input is repeatedly inputted to the motor driver, and wherein, in the motor control processing, the controller calculates the control input such that, after the sheet has reached the target stop position, the control input is equal to a hold control input required for permitting the sheet to be kept located at the target stop position and such that, at a start point of the motor control processing, the control input is not smaller than the hold control input in the motor control processing in a previous sheet conveyance operation.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be explained embodiments of the present invention with reference to the drawings.

First Embodiment

Figure 1:
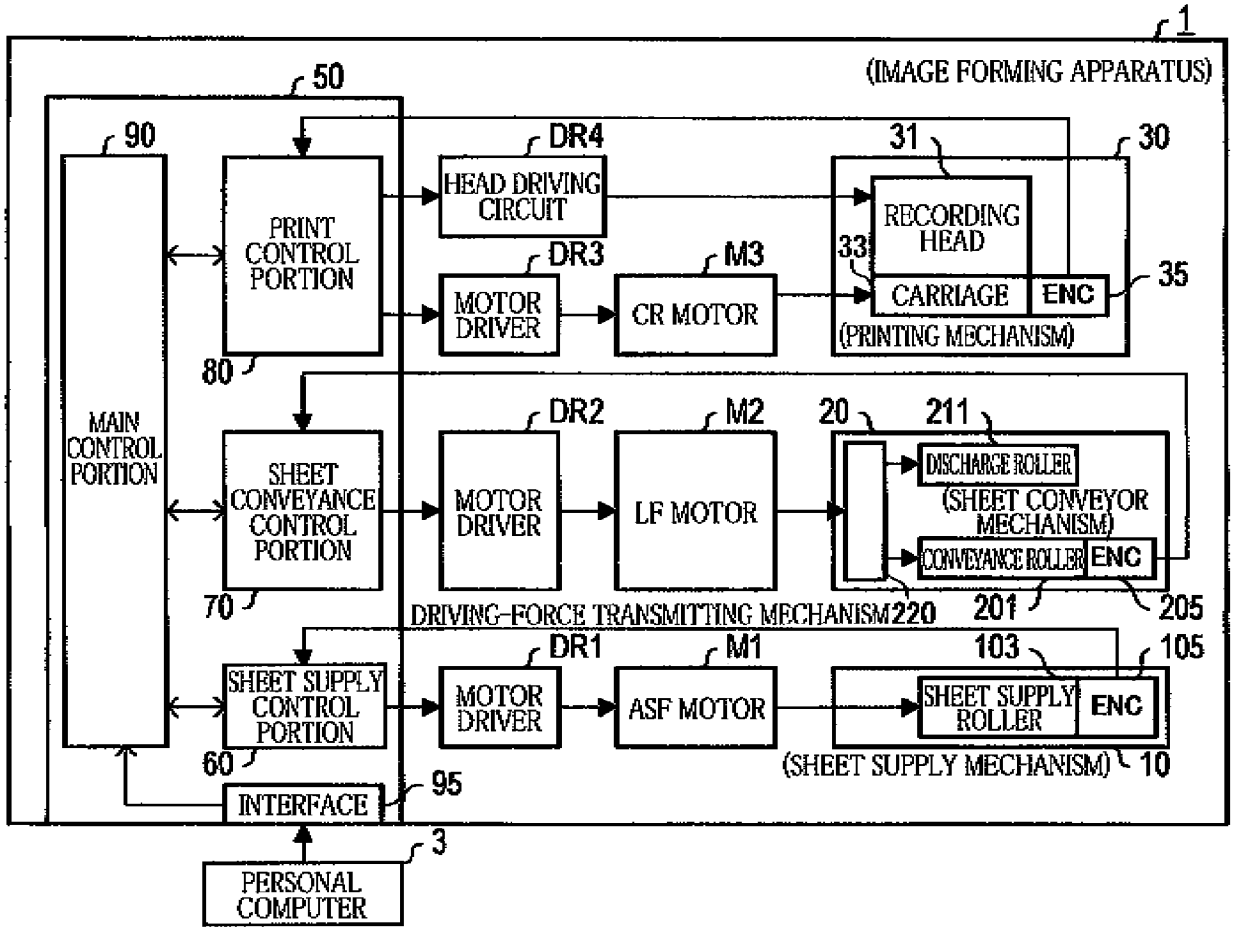
FIG. 1 is a block diagram showing a structure of an image forming apparatus according to one embodiment of the invention.

An image forming apparatus according to a first embodiment of the present invention which is generally indicated at 1 in FIG. 1 is an ink-jet printer and includes: a sheet supply mechanism 10; a sheet conveyor mechanism 20; a printing mechanism 30; a controller 50; an ASF motor M1 which is a direct-current (DC) motor for giving a driving force to the sheet supply mechanism 10; a motor driver DR1 for driving the ASF motor M1; an LF motor M2 which is a direct-current (DC) motor for giving a driving force to the sheet conveyor mechanism 20; a motor driver DR2 for driving the LF motor M2; a CR motor M3 which is a direct-current (DC) motor for giving a driving force to the printing mechanism 30; a motor driver DRS for driving the CR motor M3; and a head driving circuit DR4 for driving a recording head 31.

Figure 2:
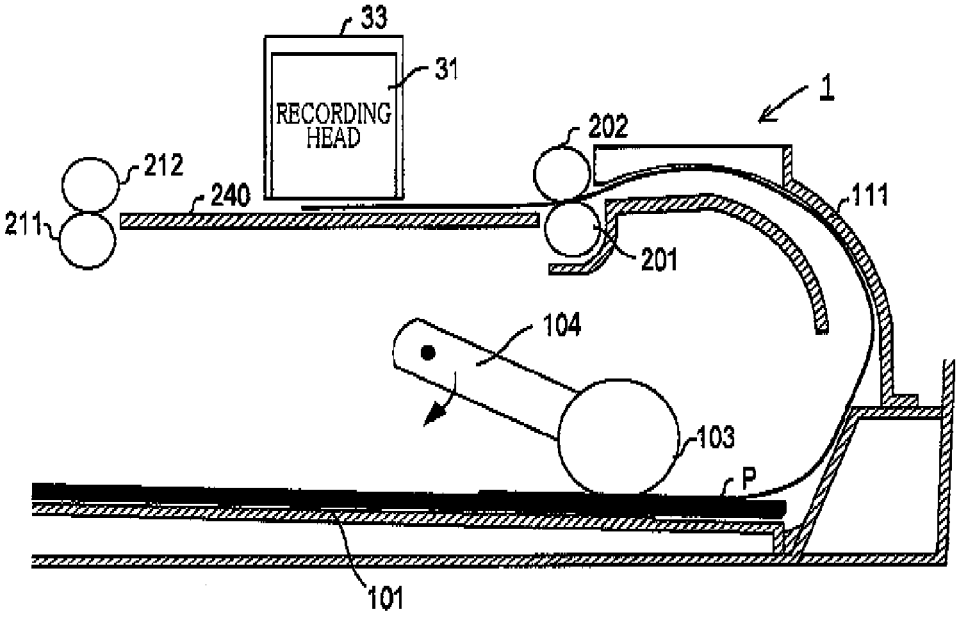
FIG. 2 is a cross-sectional view showing a mechanical structure of the image forming apparatus.

The sheet supply mechanism 10 is configured to separate sheets P accommodated in a sheet tray 101 (FIG. 2) one by one so as to supply the separated sheet P to the sheet conveyor mechanism 20. As shown in FIG. 2, the sheet supply mechanism 10 includes: the sheet tray 101 in which a plurality of sheets P are stacked; a sheet supply roller 103 configured to rotate by the diving force of the ASF motor M1; an arm 104 which holds the sheet supply roller 103 so as to be rotatable; and a rotary encoder 105 (FIG. 1) configured to output encoder signals in association with the rotation of the sheet supply roller 103.

The arm 104 is configured to press the sheet supply roller 103 onto an uppermost one of the sheets P accommodated in the sheet tray 101, by the gravity or a biasing force of a spring. In the sheet supply mechanism 10, the sheet supply roller 103 rotates by the driving force of the ASF motor M1 in a state in which the sheet supply roller 103 is pressed onto the uppermost sheet P, whereby the uppermost sheet P in the sheet tray 101 is separated and fed to a sheet conveyance path connected to the sheet conveyor mechanism 20. The sheet conveyance path between the sheet conveyor mechanism 20 and the sheet supply mechanism 10 is constituted by a U turn path 111 having a U shape. The sheet P fed from the sheet tray 101 is conveyed between a conveyance roller 201 and a pinch roller 202 of the sheet conveyor mechanism 20 while a direction of the movement of the sheet P is defined by the U turn path 111 and the sheet P is conveyed in a curved state.

As described above, the sheet conveyor mechanism 20 includes the conveyance roller 201 and the pinch roller 202 disposed so as to be opposed to the conveyance roller 201. The sheet conveyor mechanism 20 further includes: a rotary encoder 205 (FIG. 1) configured to output encoder signals in association with rotation of the conveyance roller 201; a discharge roller 211; and a pinch roller 212 disposed so as to be opposed to the discharge roller 211.

The rotary encoder 205 has a rotary plate (not shown) attached to a rotation shaft of the conveyance roller 201 and is of a known incremental type configured to read slits formed on the rotary plate so as to output the encoder signal in accordance with a result of the reading.

The discharge roller 211 is disposed on a more downstream side than the conveyance roller 201 in the sheet conveyance path. The conveyance roller 201 and the discharge roller 211 are configured to rotate in an interlocking manner by the driving force received from the LF motor M2 through a driving-force transmitting mechanism 220 (FIG. 1) that connects the rollers 201, 211 by a belt, for instance. More specifically, the conveyance roller 201 and the discharge roller 211 rotate by the same amount in the circumferential direction. The thus rotating conveyance roller 201 and the discharge roller 211 cooperate with each other to convey the sheet P supplied by the sheet supply mechanism 10 to a discharge tray (not shown) disposed on the downstream side of the discharge roller 211.

The pinch roller 202 is configured to rotate so as to follow the rotational movement of the conveyance roller 201 with the sheet P held and nipped between the pinch roller 202 and the conveyance roller 201 while the pinch roller 212 is configured to rotate so as to follow the rotational movement of the discharge roller 211 with the sheet P held and nipped between the pinch roller 212 and the discharge roller 211. The sheet P is conveyed to the downstream portion of the sheet conveyance path by the rotation of the conveyance roller 201 and the discharge roller 211 in a state in which the sheet P is held and nipped between the conveyance roller 201 and the pinch roller 202 and between the discharge roller 211 and the pinch roller 212.

A platen 240 is disposed between the conveyance roller 201 and the discharge roller 211 for supporting, from below, the sheet P conveyed from the conveyance roller 201 so as to guide the sheet P toward the discharge roller 211. To the sheet P that is conveyed from the conveyance roller 201 to the discharge roller 211, ink droplets are ejected from the recording head 31 of the printing mechanism 30, so that an image is formed on the sheet P that is located on the platen 240.

As shown in FIGS. 1 and 2, the printing mechanism 30 includes: the recording head 31 configured to eject the ink droplets from its nozzle surface that is opposed to the platen 240; a carriage 33 on which the recording head 31 is mounted; a carriage moving mechanism (not shown) configured to move the carriage 33 in a main scanning direction in a direction normal to the sheet plane of FIG. 2) by the driving force received from the CR motor M3; and a linear encoder 35 configured to output encoder signals in association with the movement of the carriage 33 in the main scanning direction.

The recording head 31 is mounted on the carriage 33 and is moved in the main scanning direction above the platen 240. During the movement of the recording head 31 in the main scanning direction, the recording head 31 ejects the ink droplets from the nozzle surface in accordance with drive signals received from the head driving circuit DR4.

The controller 50 includes; a sheet supply control portion 60 configured to execute a sheet supply control; a sheet conveyance control portion 70 configured to execute a conveyance control of the sheet P (a sheet conveyance control) supplied from the sheet tray 101 to the sheet conveyor mechanism 20; a print control portion 80 configured to execute a movement control of the carriage 33 (a movement control of the recording head 31) and a control of ink-droplet ejection (an ink-droplet ejection control) by the recording head 31; a main control portion 90 configured to control those control portions 60, 70, 80; and an interface 95 which is capable of communicating with an external personal computer (PC) 3.

The sheet supply control portion 60 is configured to detect a rotational position of the sheet supply roller 103 on the basis of the encoder signal inputted from the rotary encoder 105 and to adjust, on the basis of the detected rotational position, a driving current to be supplied from the motor driver DR1 to the ASF motor M1, thereby executing the sheet supply control. Owing to the sheet supply control, the sheet P is supplied, one by one, from the sheet tray 101 to the sheet conveyor mechanism 20.

The sheet conveyance control portion 70 is configured to detect a rotational position of the conveyance roller 201 on the basis of the encoder signal inputted from the rotary encoder 205 and to control the LF motor M2 on the basis of the detected rotational position, thereby executing the conveyance control of the sheet P. Owing to the sheet conveyance control, the sheet P is conveyed in a sub scanning direction perpendicular to the main scanning direction.

Figure 3:
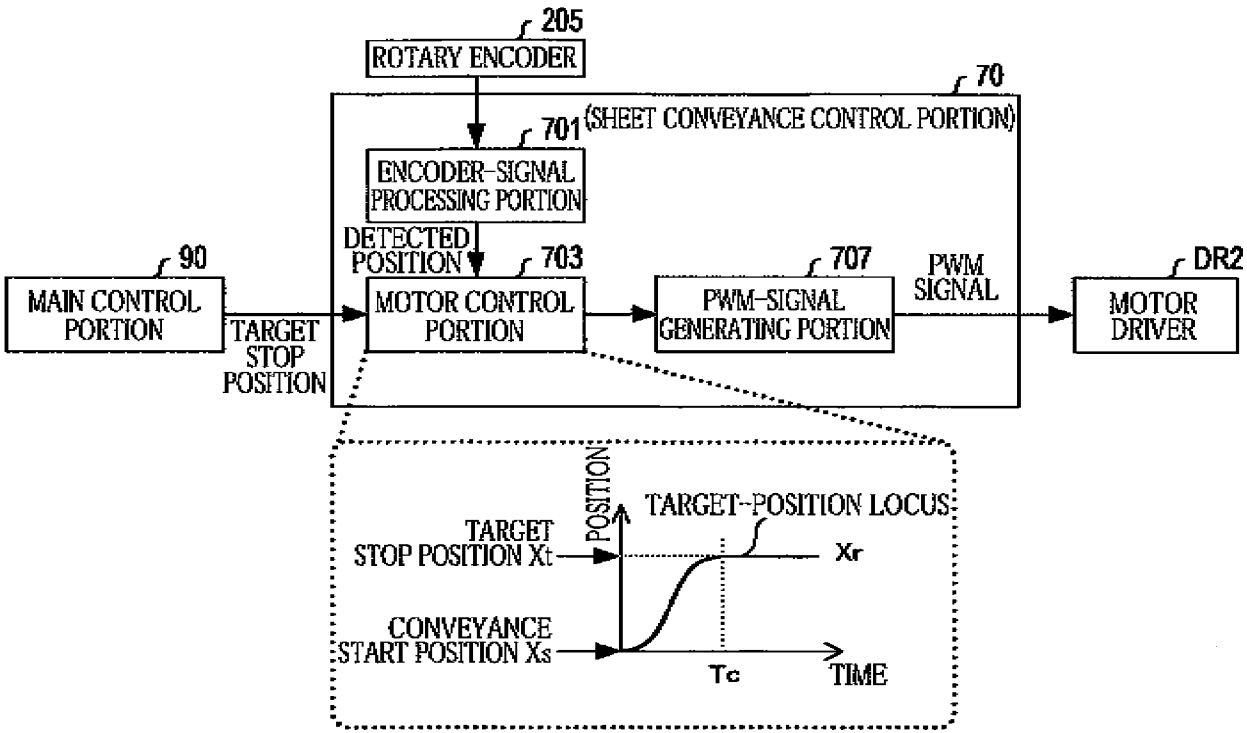
FIG. 3 is a block diagram showing a structure of a sheet conveyance control portion.

FIG. 3 shows a detailed structure of the sheet conveyance control portion 70. The sheet conveyance control portion 70 includes: an encoder-signal processing portion 701; a motor control portion 703; and a PWM-signal generating portion 707. The encoder-signal processing portion 701 is configured to detect a rotational position X of the conveyance roller 201 on the basis of the encoder signal inputted from the rotary encoder 205. As described above, the sheet P is conveyed by the rotation of the conveyance roller 201 and the discharge roller 211. Accordingly, the rotational position X of the conveyance roller 201 corresponds to the position of the sheet P. In the present embodiment, the sheet position is indirectly detected by the detection of the rotational position X of the conveyance roller 201. Hereinafter, the position detected by the encoder-signal processing portion 701 will be referred to as a "detected position" where appropriate.

The motor control portion 703 is configured to successively calculate a control input U with respect to the LF motor M2, i.e., an operation amount with respect to the LF motor M2, and to input the control input U to the PWM-signal generating portion 707, when a control start command is inputted thereto from the main control portion 90. More specifically, when the control start command is inputted from the main control portion 90, the motor control portion 703 sets a detected position X at this time point as a conveyance start position Xs and sets a target-position locus from the conveyance start position Xs to a target stop position Xt. For each control cycle, the motor control portion 703 calculates a control input (a feedback control input) Ufb on the basis of: a deviation e (=Xr−X) of the detected position X at a current time point from the target position Xr at the current time point indicated by the target-position locus. The feedback control input Ufb is for reducing the deviation. The motor control portion 703 corrects the feedback control input Ufb as needed and inputs the corrected control input U to the PWM-signal generating portion 707. In the region enclosed by the dashed line in FIG. 3, the target-position locus used in the sheet conveyance is shown. In the target-position locus, the target position Xr increases from the conveyance start position Xs to the target stop position Xt and the target position Xr is kept constant at the target stop position Xt after having reached the target stop position Xt.

The PWM-signal generating portion 707 is configured to generate a PWM signal for driving the LF motor M2 by a driving current corresponding to the control input U inputted from the motor control portion 703 and to input the PWM signal to the motor driver DR2. The motor driver DR2 is operable according to the PWM signal so as to supply, to the LF motor M2, the driving current corresponding to the control input U.

The print control portion 80 (FIG. 1) is configured to control the CR motor M3 via the motor driver DR3 for thereby permitting the recording head 31 to one-way move in the main scanning direction and to control the recording head 31 in the one-way movement for thereby permitting the recording head 31 to eject the ink droplets corresponding to the image data of an image to be printed that is inputted from the PC 3 through the interface 95. As a result, a line image with a prescribed width (hereinafter referred to as a "one-path line image" where appropriate) is formed on the sheet P. More specifically, the print control portion 80 detects a moving speed of the carriage 33 and accordingly a moving speed of the recording head 31 on the basis of the encoder signal inputted from the linear encoder 35, thereby executing the movement control of the recording head 31.

The main control portion 9 is configured to control the sheet supply control portion 60, the sheet conveyance control portion 70, and the print control portion 80, such that the sheet P is supplied one by one to the sheet conveyor mechanism 20 and the supplied sheet P is intermittently conveyed by the sheet conveyor mechanism 20 and such that, when the sheet stops, the one-path line image is formed on the sheet P by the print control portion 80. Thus, the main control portion 90 is configured to sequentially feed the sheet P to an image forming location on the platen 240 and to form, on the sheet P, a series of the image corresponding to the image data of the image to be formed that is inputted from the PC 3 through the interface 95.

Figure 4A:
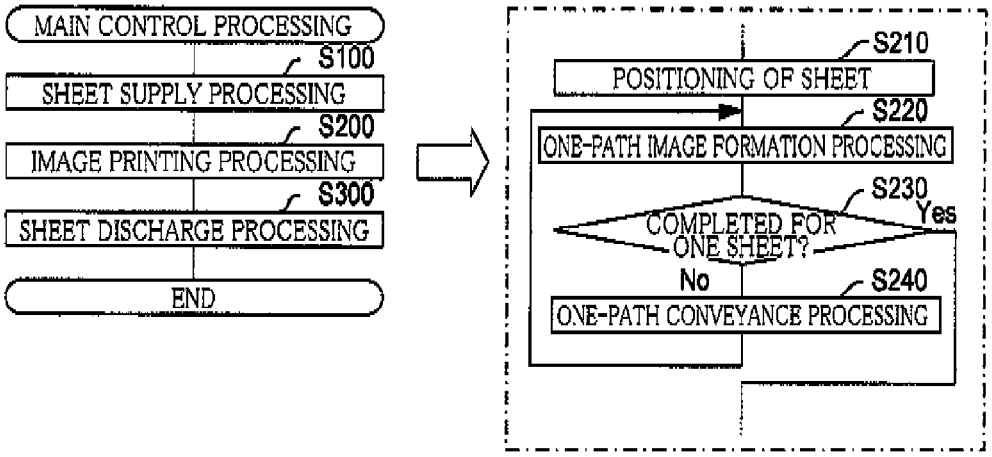
FIG. 4 is a flow chart showing processing executed by a main control portion.

The processing executed by the main control portion 90 will be explained with reference to the flow chart of FIG. 4A. The main control portion 90 executes main control processing shown in FIG. 4A every time when the image data for one sheet is inputted from the PC 3 through the interface 95.

When the main control processing starts, the main control portion 90 initially executes sheet supply processing. In the sheet supply processing, the sheet supply control portion 60 is operated so as to execute the rotation control of the ASF motor M1, whereby the sheet P is conveyed by the sheet supply mechanism 10 (the sheet supply roller 103) to a start point of conveyance by the sheet conveyor mechanism 20 (i.e., a contact point of the conveyance roller 201 and the pinch roller 202) (S100).

After the processing described above, the main control portion 90 executes image printing processing (S200). In the image printing processing, the leading end of the sheet P is fed such that the sheet is positioned (registered) at a print start position by the sheet conveyance control portion 70 (S210). More specifically, the main control portion 90 specifies the target stop position Xt for the sheet conveyance control portion 70 and inputs the control start command to the sheet conveyance control portion 70, thereby permitting the sheet conveyance control portion 70 to execute the sheet conveyance control for conveying the sheet P to the specified target stop position Xt (S210). As a result, the leading end of the sheet P is fed, and the sheet P is kept at rest at a position corresponding to the target stop position Xt.

After the sheet P has been positioned as described above, the main control portion 90 executes image formation processing for one path (one-path image formation processing) (S220). More specifically, the print control portion 80 is operated so as to execute the movement control of the carriage 33, thereby permitting the recording head 31 to one-way move in the main scanning direction. Further during the movement of the recording head 31, the main control portion 90 controls the print control portion 80 to execute a driving control of the recording head 31 (i.e., the ink-droplet ejection control) via the head driving circuit DR4 (S220). According to the driving control, the one-path line image is formed on the sheet P.

After completion of the ejection of the ink droplets for one path by the recording head 31, the main control portion 90 judges whether image formation for one sheet has ended or not (S230). Where the image formation for one sheet is not ended yet (S230: No), conveyance processing for one-path (one-path conveyance processing) is executed (S240). More specifically, the main control portion 90 updates the target stop position Xt so as to be shifted from the current position toward the downstream side in the sheet conveyance direction by a distance corresponding to the width of the line image in the sub scanning direction. Further, the main control portion 90 specifies the updated target stop position Xt to the sheet conveyance control portion 70 for thereby permitting the sheet conveyance control portion 70 to execute the sheet conveyance control to the specified target stop position Xt. As a result, the sheet P is conveyed to the target stop position Xt and is kept at rest at the position.

In the present embodiment, even after the sheet P has reached the target stop position Xt, in other words, even after the rotational position of the conveyance roller 201 has reached the target stop position Xt, the control input U is continued to be calculated utilizing a technique of a feedback control and the LF motor M2 is driven by supplying the driving current corresponding to the control input U, until a control suspension command is inputted from the main control portion 90 to the sheet conveyance control portion 70, so as to prevent the reverse rotation of the conveyance roller 201 due to a load, which reverse rotation of the conveyance roller 201 would cause retracting of the sheet P. Owing to the operation of the sheet conveyance control portion 70, the sheet P is held at the target stop position Xt.

At timing when the sheet P stops at the target stop position Xt, the control flow returns to S220, namely, the main control portion 90 executes the above-described one-path image formation processing. Thus, the one-path line image is formed on the sheet P that is at rest at the target stop position Xt.

In this respect, the control flow returns to S220 in which the main control portion 90 executes the one-path image formation processing, at a time point when a prescribed time has elapsed from a time point when the control start command is inputted to the sheet conveyance control portion 70, whereby the one-path image formation processing is executable on the sheet P that is at rest at the target stop position Xt.

Thus, the main control portion 90 repeatedly executes the processing (S220-S240) in which the sheet P is intermittently conveyed and the one-path line image is formed on the sheet P every time when the sheet P is intermittently conveyed. Thus, in the present apparatus, a sheet conveyance operation and an image forming operation are repeated alternately a plurality of times. Where the main control portion 90 judges that the image formation for one sheet has ended (S230: Yes), the main control portion 90 implements S300 to execute discharge processing. That is, the main control portion 90 controls the sheet conveyance control portion 70 to execute processing in which the conveyance roller 201 and the discharge roller 211 are rotated, until the sheet P is discharged. Thereafter, the main control processing shown in FIG. 4 is ended.

Figure 4B:
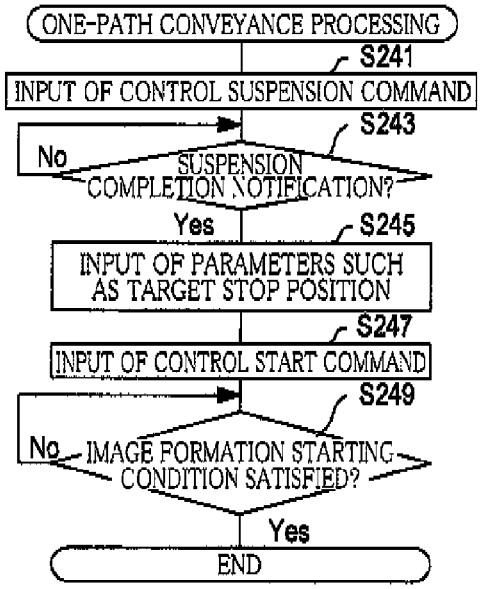
Figure 5:
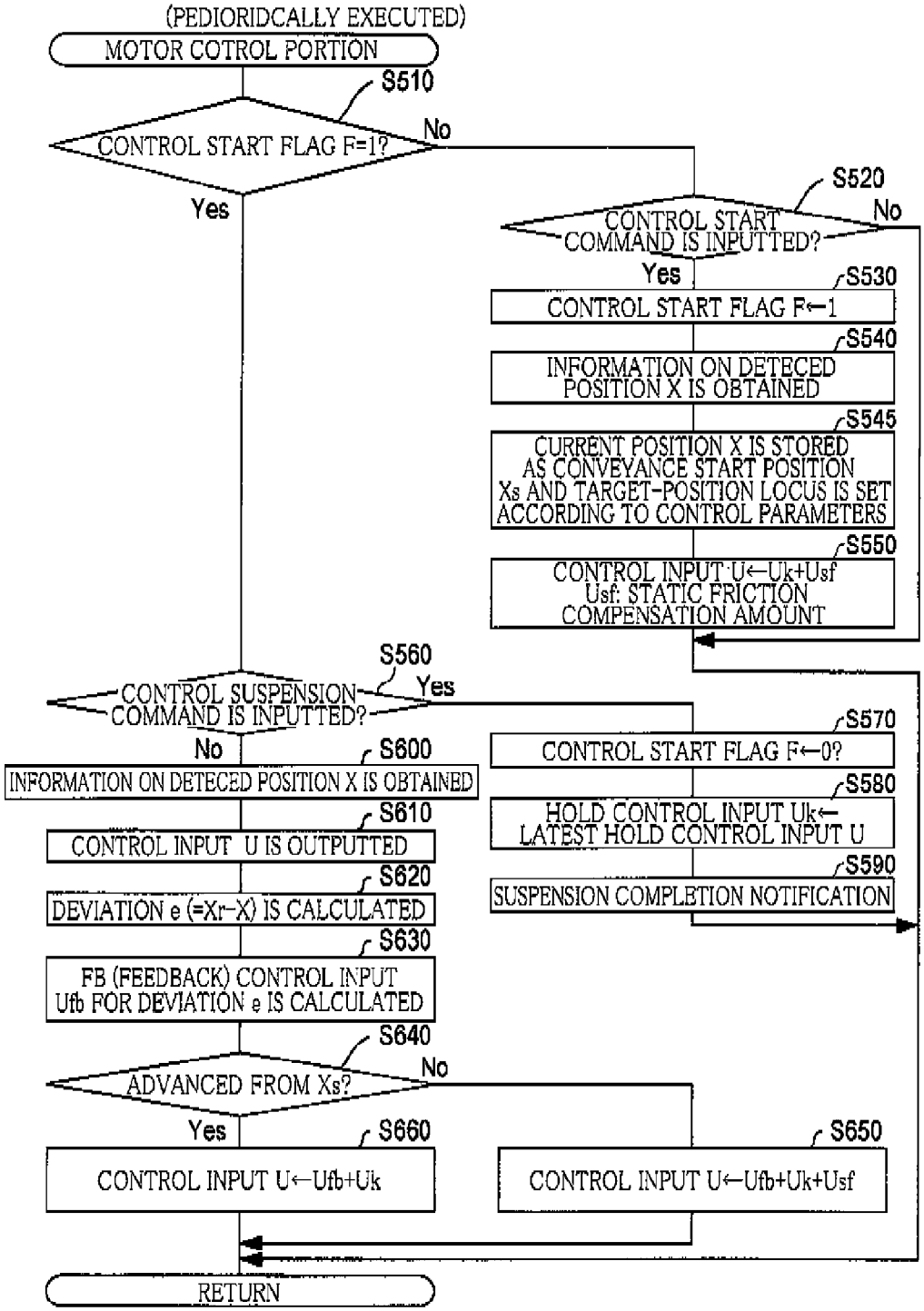
FIG. 5 is a flow chart showing periodic processing executed by a motor control portion in a first embodiment.

There will be next explained details of the one-path conveyance processing executed in S240 and details of processing executed by the sheet conveyance control portion 70 (especially, the motor control portion 703) in response to the control start command and the control suspension command inputted from the main control portion 90 in the one-path conveyance processing, with reference to FIGS. 4B and 5. FIG. 4B is a flow chart showing the details of the one-path conveyance processing executed in S240.

When the one-path conveyance processing is initiated, the main control portion 90 inputs the control suspension command to the motor control portion 703 of the sheet conveyance control portion 70, for permitting the sheet conveyance control portion 70 to execute the sheet conveyance control to a newly set target stop position Xt (S241). When such a control suspension command is inputted, the motor control portion 703 inputs, to the main control portion 90, a suspension completion notification as a response signal.

Where the suspension completion notification is inputted from the motor control portion 703 to the main control portion 90 (S243: Yes), the main control portion 90 sets, for the motor control portion 703, control parameters necessary for the sheet conveyance control, such as the target stop position Xt and a conveyance time Tc (S245).

Subsequently, the control start command is inputted from the main control portion 90 to the motor control portion 703 (S247), and the main control portion 90 permits the motor control portion 703 to execute the sheet conveyance control (the rotation control of the conveyance roller 201) based on the new control parameters set in S245. Owing to the above-described setting of the control parameters, the motor control portion 703 sets the target-position locus in which the sheet P can be conveyed from the conveyance start position Xs to the target stop position Xt in the conveyance time Tc, and the sheet conveyance control based on the target-position locus is executed.

Where an image formation starting condition is satisfied (S249: Yes), the current one-path conveyance processing is ended, and S220 is then implemented. For instance, where a time corresponding to the conveyance time Tc elapses, it is judged that the image formation starting condition has been satisfied, and the current one-path conveyance processing is ended. Then S220 is implemented.

The motor control portion 703 periodically executes processing shown in FIG. 5, whereby processing in response to the control start command and the control suspension command inputted from the main control portion 90 is executed. Hereinafter, the above-described processing periodically executed by the motor control portion 703 will be referred to as the "periodic processing". The periodic processing is executed so as to correspond to the one-path sheet conveyance control and corresponds to a motor control processing.

When the periodic processing shown in FIG. 5 is started, the motor control portion 703 initially judges whether a control start flag F is set at "1" or not (S510). In this respect, an initial value of the control start flag F is "0". The control start flag F is reset at "0" when the control suspension command is inputted from the main control portion 90.

Where it is judged that the control start flag is set at "0" (S510: No), the motor control portion 703 judges whether or not the control start command has been inputted from the main control portion 90 (S520). Where the control start command is not yet inputted (S520: No), the current execution cycle of the periodic processing is ended. By repeatedly executing the periodic processing, the motor control portion 703 stands by until the control start command is inputted from the main control portion 90.

Where the control start command is inputted (S520: Yes), the control start flag F is set at "1" (S530). Further, the motor control portion 703 obtains information as to the current detected position X from the encoder-signal processing portion 701 (S540). On the basis of the obtained information, the motor control portion 703 stores the current position X as the conveyance start position Xs and sets the target-position locus according to the control parameters set at a time point when the control start command is inputted (S545). More specifically, the target-position locus is set in which the target position Xr smoothly changes from the conveyance start position Xs to the target stop position Xt in a time period from a control start time (t=0) to a time (t=Tc) corresponding to the conveyance time Tc and in which the target position Xr reaches the target stop position Xt in the time t=Tc. In this respect, the target stop position Xt set as the control parameter by the main control portion 90 is described as a target conveyance amount δX from the current position. Accordingly, when the target-position locus is set, the target stop position Xt is replaced with a value in a coordinate system corresponding to the detected position X by the encoder-signal processing portion 701. That is, the target stop position Xt is converted into the value in which δX is added to the conveyance start position Xs.

When the processing in S545 is completed, the motor control portion 703 sets the control input U to be inputted to the PWM-signal generating portion 707 in the next execution cycle of the periodic processing, as an addition value in which a static friction compensation amount Usf is added to a hold control input Uk stored when S580 of the previous execution cycle is implemented (S550). The static friction compensation amount Usf is a control input for giving, to the conveyance roller 201, a driving force corresponding to static friction force that acts on the conveyance roller 201. The static friction compensation amount Usf is estimated by a designer in advance in a design stage and sets for the motor control portion 703. Where the hold control input Uk is not stored when S550 is implemented, a default value set at the design stage is set as the hold control input Uk, and the control input U is set according to the technique described above. Thereafter, the current execution cycle of the periodic processing is ended.

In the periodic processing after the control start flag F is set at "1" by the input of the control start command, the following processing is executed. That is, the motor control portion 703 makes an affirmative judgment in S510, and S560 is subsequently implemented to judge whether the control suspension command has been inputted from the main control portion 90.

Where it is judged that the control suspension command is not yet inputted (S560: No), the processing in S600-S660 is implemented. In S600, information as to the current detected position X is obtained from the encoder-signal processing portion 701. In S610, the control input U set in the previous execution cycle of the periodic processing is inputted to the PWM-signal generating portion 707, whereby the driving current corresponding to the control input U is inputted to the LF motor M2.

Thereafter, the motor control portion 703 calculates the deviation e=Xr−X of the current detected position X from the target position Xr corresponding to the current time t and calculates the control input Ufb corresponding to the deviation e (S630). Since the control input Ufb is based on the deviation e of the current detected position X from the target position Xr at the current time t indicated by the target-position locus, namely, the control input Ufb is obtained utilizing the technique of the so-called feedback control, the control input Ufb is represented as the feedback control input Ufb. More specifically, the feedback control input Ufb is calculated using a prescribed transfer function which serves as a controller. For instance, the control input Ufb may be software calculated by substituting the deviation e in the prescribed transfer function. As the controller, there are known a Proportional (P) controller, a Proportional Integral (PI) controller, a Proportional Integral Derivative (PID) controller, etc.

After the calculation of the feedback control input Ufb has completed (S630), the motor control portion 703 implements S640 to judge whether or not the current position X is a position which has advanced from the conveyance start position Xs in the conveyance direction, thereby judging whether or not the conveyance roller 201 is under movement getting out of the stationary state.

Where the current position X is not located at the position which has advanced from the conveyance start position Xs, in other words, where the detected position X coincides with the conveyance start position Xs, the motor control portion 703 sets, as the control input U to be inputted to the PWM-signal generating portion 707 in the next execution cycle of the periodic processing, an addition value Ufb+Uk+Usf obtained by adding the hold control input Uk and the static friction compensation amount Usf to the feedback control input Ufb (S650). Thereafter, the current execution cycle of the periodic processing is ended.

On the other hand, where the current position X is located at the position which has advanced from the conveyance start position Xs (S640: Yes), the motor control portion 703 sets, as the control input U to be inputted to the PWM-signal generating portion 707 in the next execution cycle of the periodic processing, an addition value Ufb+Uk obtained by adding the hold control input Uk to the feedback control input Ufb (S660). Thereafter, the current execution cycle of the periodic processing is ended.

Where the control suspension command is inputted from the main control portion 90 (S560: Yes), the motor control portion 703 sets the control start flag F at "0" (S570) and stores the latest control input U as the hold control input Uk (S580). Here, "the latest control input" U is the control input U calculated in the previous execution cycle of the periodic processing and may be the control input U to be currently inputted to the PWM-signal generating portion 707 or may be the control input U which was finally inputted to the PWM-signal generating portion 707 in the previous execution cycle of the periodic processing.

Where the processing in S580 is ended, the motor control portion 703 implements S590 to input, to the main control portion 90, the suspension completion notification as the response signal to the control suspension command (S590). Thereafter, the current execution cycle of the periodic processing is ended.

The details of the periodic processing is explained hereinabove. By repeating the periodic processing described above, the following operation is attained.

Figure 6:
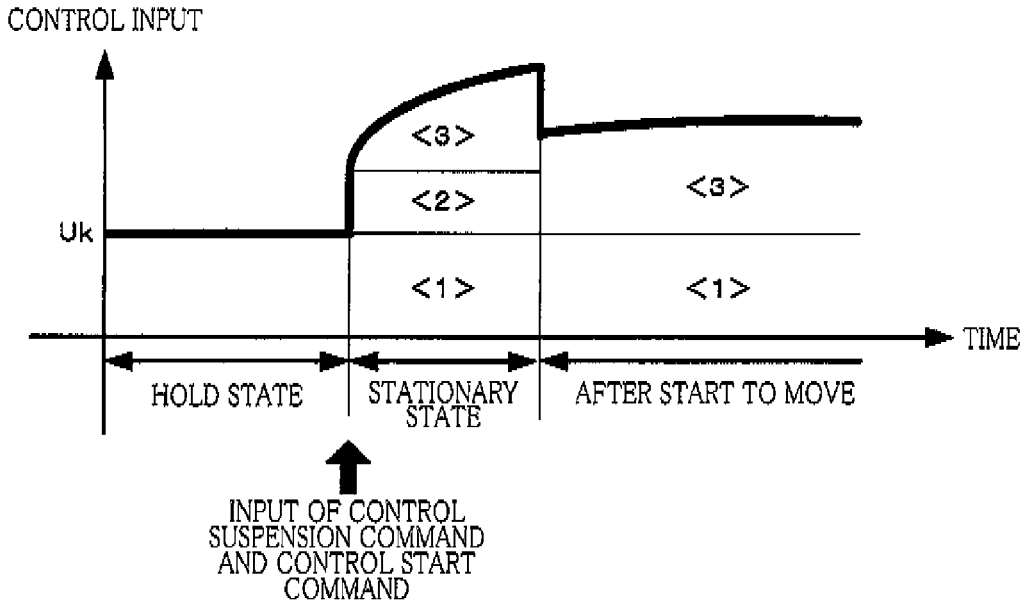
FIG. 6 is a graph showing a change of a control input U in the first embodiment.
Figure 7:
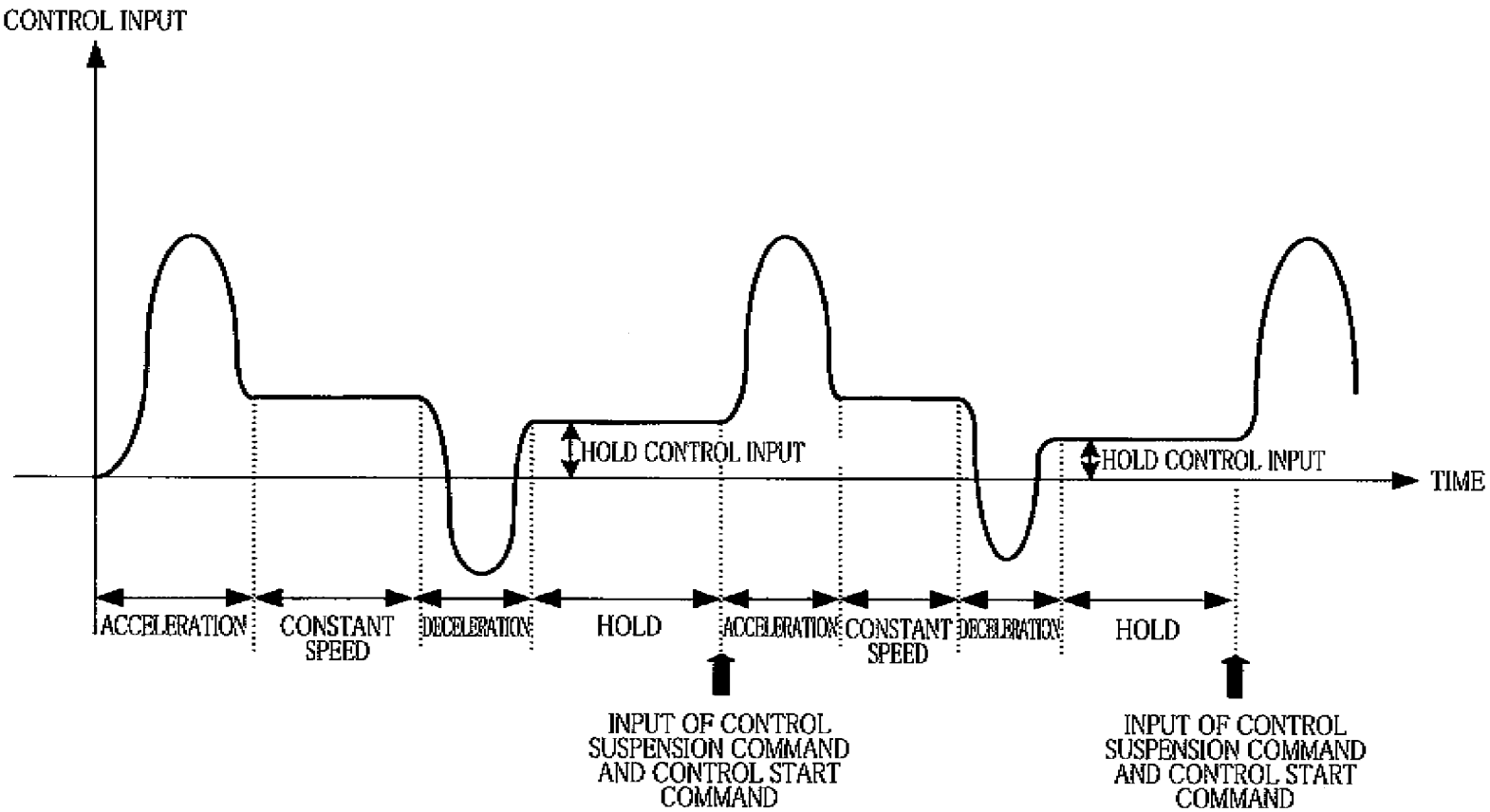
FIG. 7 is a graph showing an example of setting an initial value of the control input U every time when a control start command is inputted.

In other words, as shown in FIGS. 6 and 7, when the sheet conveyance control to the target stop position Xt is executed after the input of the control start command, from the main control portion 90, there is used, as a correction amount, the latest control input (the hold control input Uk) in the previous sheet conveyance control which was ended by the input of the control suspension command from the main control portion 90 immediately before the execution of the sheet conveyance control. More specifically, there is set as, the control input U, the addition value obtained by adding, to the feedback control input Ufb as a main control input, this correction amount (the hold control input Uk) and the static friction compensation amount Usf as a second correction amount. By calculating the correction amount as described above, the sheet can quickly start moving from the stationary state, thereby improving throughput relating to the sheet conveyance.

Accordingly, in each sheet conveyance control (i.e., in the motor control processing), a value not smaller than the hold control input Uk, namely, a value which is larger than or equal to the hold control input Uk, is set as an initial value of the control input U, and the driving current which prevents the reverse rotation of the conveyance roller 201 that would cause retracting of the sheet P is supplied to the LF motor M2 at the start point of the control (the motor control processing). In FIG. 6, "<1>" shows the hold control input Uk, "<2>" shows the static friction compensation amount Usf, and "<3>" shows the feedback control input Ufb.

After the control is started, the feedback control input Ufb gradually increases by an increase of the deviation e in association with the updating of the target position Xr and the control input U accordingly increases, whereby the conveyance roller 201 overcomes the static friction force and rotates to cause the sheet P to start moving.

At the time point when the conveyance roller 201 rotates and the sheet P starts moving, the static friction compensation amount Usf is stopped to be added to the feedback control input Ufb. In other words, the addition value of the feedback control input Ufb and the hold control input Uk is calculated as the control input U. After the sheet P has started moving, the sheet conveyance control based on the thus calculated control input U is executed. The addition of the static friction compensation amount Usf is stopped after the sheet P has started moving, for the purpose of restraining abrupt acceleration by the control input U which would become excessive as a result of absence of the static friction force.

In the present embodiment, the thus calculated control input U is inputted to the PWM-signal generating potion 703. Accordingly, the control input U is appropriately switched between before and after initiation of the movement of the sheet P. Therefore, it is possible to prevent abrupt acceleration after initiation of the movement and to suitably convey the sheet P to the target stop position.

The target-position locus is a position locus including an acceleration section, a constant-speed section, and a deceleration section. Accordingly, the control input U after initiation of the movement of the sheet P gradually increases to attain acceleration and subsequently gradually decreases as the target position Xr approaches the constant-speed section (FIG. 7). In the constant-speed section, the control input U is kept substantially constant. Thereafter, as the target position Xr approaches the target stop position Xt, the control input U is set so as to be negative for deceleration. After having reached the target stop position Xt, the control input (i.e., the hold control input) which prevents the reverse rotation of the conveyance roller 201 that would cause retracting of the sheet P is calculated, and the driving current (i.e., the hold current) necessary for keeping the conveyance roller 201 and the sheet P at rest is supplied to the LF motor M2.

In the present embodiment, even after the sheet P is at rest at the target stop position Xt, the calculation of the feedback control input Ufb based on the deviation e of the detected position X from the target position Xr equal to the target stop position Xt is continued, namely, the feedback control is continued, whereby the control input (i.e., the hold control input) which prevents the reverse rotation of the conveyance roller 201 that would cause retracting of the sheet P is continuously calculated.

The calculation of the hold control input (i.e., the control input U) according to the technique of the feedback control is continuously executed until the control suspension command is inputted, and the hold current suitably determined in accordance with the actual load at each time point is supplied to the LF motor M2.

Where the control start command is inputted after the control suspension command has been inputted, the control input that is not smaller than the hold control input Uk is set as the initial value, as described above, and a new sheet conveyance control is initiated. That is, in the present embodiment, every time when the new sheet conveyance control is initiated after the input of the control start command, the control input which is not smaller than the hold control input Uk and which is suitable for the current situation is set as the initial value of the control input U, whereby the reverse rotation of the conveyance roller 201 (the retracting of the sheet P) due to the load can be appropriately restrained.

Therefore, in the image forming apparatus 1 according to the present embodiment, the sheet P can be intermittently conveyed by the prescribed amount δX with high accuracy. As a result, in the process of the repeated and alternate execution of the sheet conveyance operation and the image formation operation, it is possible to prevent the quality of the image formed on the sheet P from being degraded by sheet conveyance errors due to a variation of the load that acts on the sheet conveyance roller 201 and the sheet P. In other words, in the present embodiment, it is possible to attain highly accurate sheet conveyance, so that a high-quality image can be formed on the sheet P.

In the present embodiment, the new periodic processing (i.e., the new motor control processing) is started using the latest hold control input for attaining the sheet conveyance operation. Accordingly, the control input U can be calculated from the initial value suitably set in accordance with the current load, thereby more effectively restraining retracting of the sheet due to the load and accordingly attaining highly accurate sheet conveyance.

Second Embodiment

There will be explained a second embodiment with reference to FIGS. 8 and 9. The image forming apparatus 1 of the second embodiment differs from the image forming apparatus 1 of the first embodiment only in that the details of the periodic processing executed by the motor control portion 703 are different from those of the first embodiment. Accordingly, in the following explanation, processing details in steps of the periodic processing which are different from those of the first embodiment will be mainly explained, and explanation of other processing details which are the same as in the first embodiment is suitably omitted.

Figure 8:
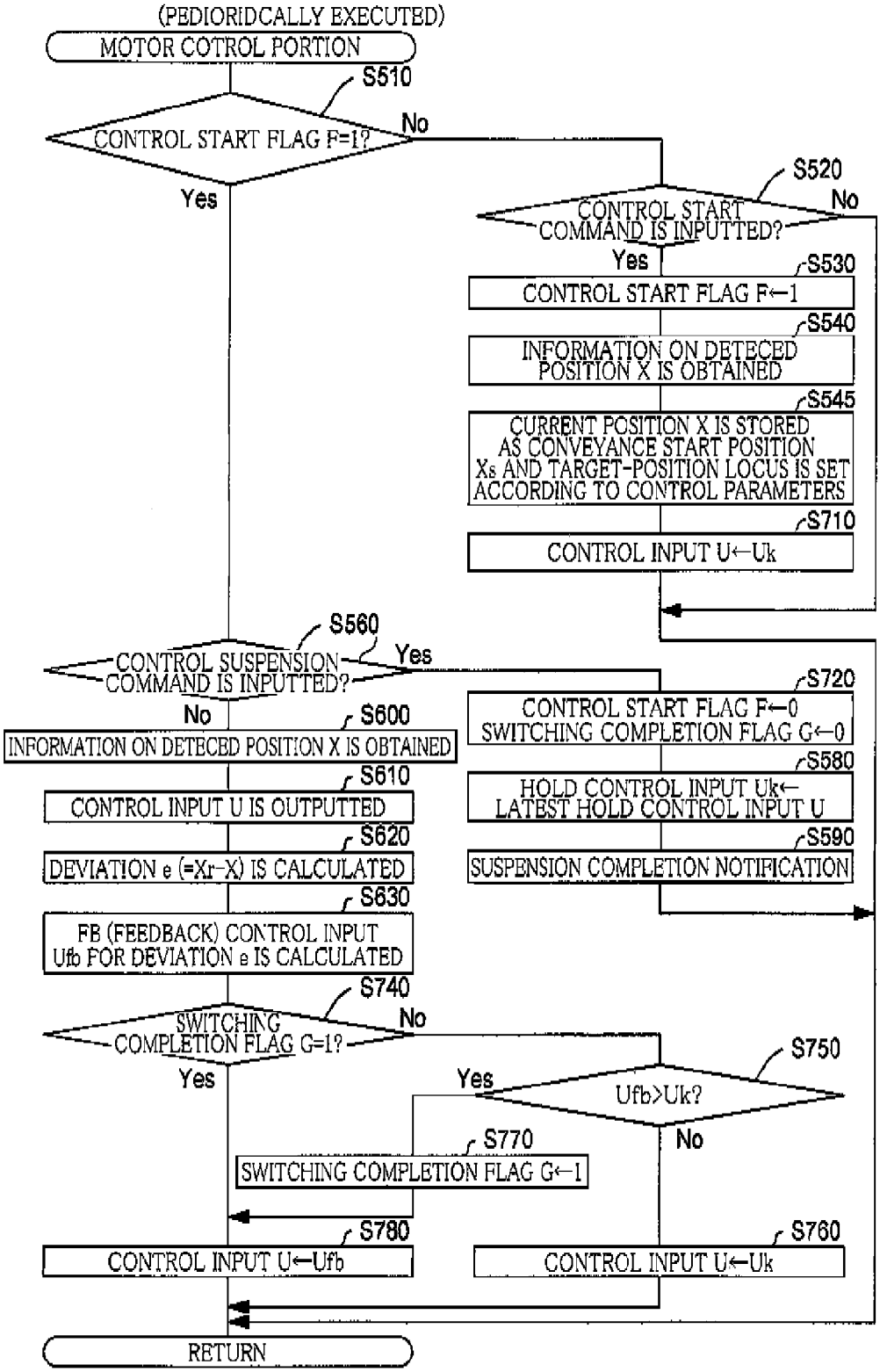
FIG. 8 is a flow chart showing periodic processing executed by the motor control portion in a second embodiment.
Figure 9:
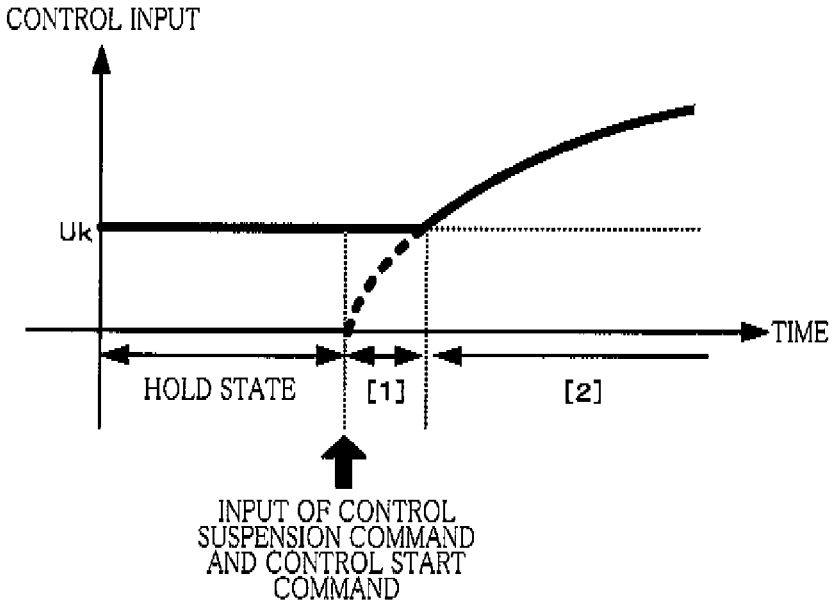
FIG. 9 is a graph showing a change of the control input U in the second embodiment.

FIG. 8 is a flow chart showing a periodic processing in the second embodiment. As apparent from comparison between FIG. 5 and FIG. 8, among the processing of S510-S660 in the periodic processing shown in FIG. 5, the processing of S550 is replaced with the processing of S710, the processing of S570 is replaced with the processing of S720, and the processing of S640-S660 is replaced with the processing of S740-S780, in the image forming apparatus 1 of the second embodiment.

In the present embodiment, the static friction compensation amount Usf is not used. Accordingly, in S710 as a replacement for S550, the hold control input Uk is set as the control input U. Further, in the processing in S720 as a replacement for S570, a switching completion flag G as well as the control start flag F is initialized, namely, set at "0". In the switching completion flag G, the initial value is set at "0" as well as the control start flag F.

In S740-S780 as a replacement for S640-S660, the following processing is executed. When the control start flag F is set at "1" by the input of the control start command, the motor control portion 703 obtains information on the detected position X from the encoder-signal processing portion 701 (S600) and outputs, to the PWM-signal generating portion 707, the control input U set in the previous execution cycle of the periodic processing (S610). Subsequently, the motor control portion 703 calculates the deviation e of the detected position X from the target position Xr (S620) and calculates, as the main control input, the feedback control input Ufb corresponding to the deviation e (S630). Thereafter, S740 is implemented.

In S740, the motor control portion 703 judges whether the switching completion flag G is set at "1" or not. Where the switching completion flag G is not set at "1" (S740: No), it is judged whether the feedback control input Ufb calculated in S630 is larger than the hold control input Uk (S750). Where it is judged that the feedback control input Ufb is not larger than the hold control input Uk (S750: No), the control input U to be inputted to the PWM-signal generating portion 707 in the next execution cycle of the periodic processing is set to the hold control input Uk (S760). Thereafter, the current execution cycle of the periodic processing is ended.

On the other hand, where the feedback control input Ufb is larger than the hold control input Uk (S750: Yes), the switching completion flag G is set at "1" (S770), and the control input U to be inputted to the PWM-signal generating portion 707 in the next execution cycle of the periodic processing is set to the feedback control input Ufb (S780). Thereafter, the current execution cycle of the periodic processing is ended.

In the present embodiment, the execution of the periodic processing described above attains the operation shown in FIG. 9. That is, when a new sheet conveyance control is initiated after the input of the control start command, the hold control input Uk is inputted, as the control input U, to the PWM-signal generating portion 707 until the feedback control input Ufb exceeds the hold control input Uk (section [1] in FIG. 9). After the feedback control input Ufb exceeds the hold control input Uk, the feedback control input Ufb is inputted, as the control input U, to the PWM-signal generating portion 707 (section [2] in FIG. 9). The dashed line in FIG. 9 shows the feedback control input Ufb in the section W.

In the present embodiment, where the feedback control input Ufb becomes larger than the hold control input Uk, the switching completion flag G is kept at "1" until the control suspension command is inputted. Accordingly, in the section [2], the feedback control input Ufb is inputted as the control input U irrespective of which one of the feedback control input Ufb and the hold control input Uk is larger.

Even where the control input U is set as described in the second embodiment explained above, the initial value of the control input U is set to be not smaller than the hold control input Uk. Accordingly, as in the first embodiment, it is possible to execute the sheet conveyance control while preventing the reverse rotation of the conveyance roller 201 that would cause retracting of the sheet P.

Third Embodiment

Figure 10A:
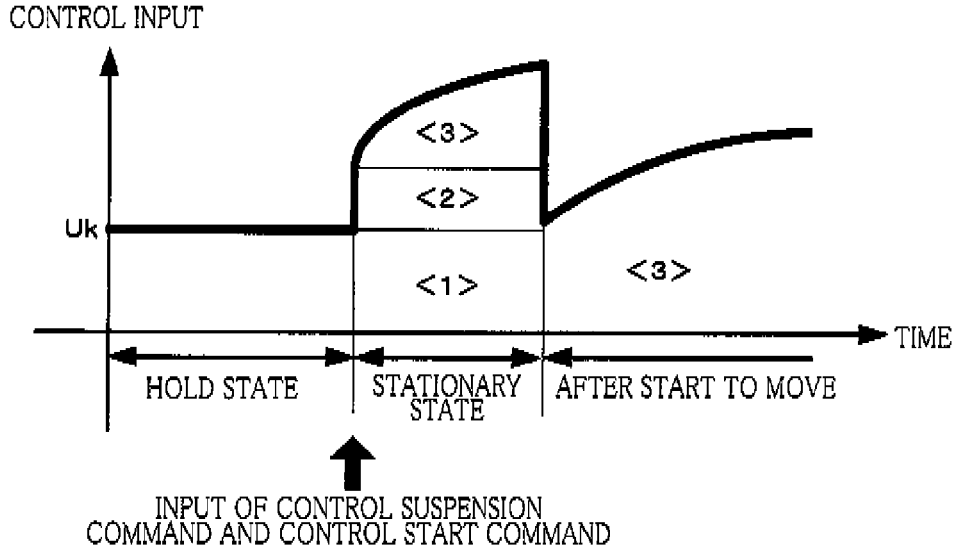
FIG. 10A is a graph showing a change of the control input U in the third embodiment and FIG. 10B is a graph showing a change of the control input U in the fourth embodiment.

There will be next explained a third embodiment of the invention with reference to FIG. 10A. The graph of FIG. 10A shows a locus of the control input U set in the periodic processing according to the third embodiment. The signs <1>, <2>, <8> in FIG. 10A respectively correspond to the signs <1>, <2>, <3> in FIG. 6.

In the first embodiment, where an affirmative judgment is made in S640, the addition value Ufb+Uk obtained by adding the hold control input Uk to the feedback control input Ufb is set as the control input U (S660). As shown in FIG. 10A, in the present embodiment, where the conveyance roller 201 and the sheet P start moving and accordingly an affirmative judgment is made in S640, the feedback control input Ufb that is the main control input is set as the control input U without addition of the hold control input Uk. That is, in S660, the control input U is set so as to be equal to the feedback control input Ufb (U=Ufb).

Even where the control input U is set as described in the third embodiment explained above, the initial value of the control input U is set to be not smaller than the hold control input Uk. Accordingly, as in the first embodiment, it is possible to execute the sheet conveyance control while preventing the reverse rotation of the conveyance roller 201 that would cause retracting of the sheet P. Further, in the present embodiment, it is possible to prevent the control input U after initiation of the movement from becoming excessive, thereby restraining abrupt acceleration immediately after initiation of the movement and suitably conveying the sheet to the target stop position Xt. Therefore, a highly accurate sheet conveyance control can be attained.

Fourth Embodiment

Figure 10B:
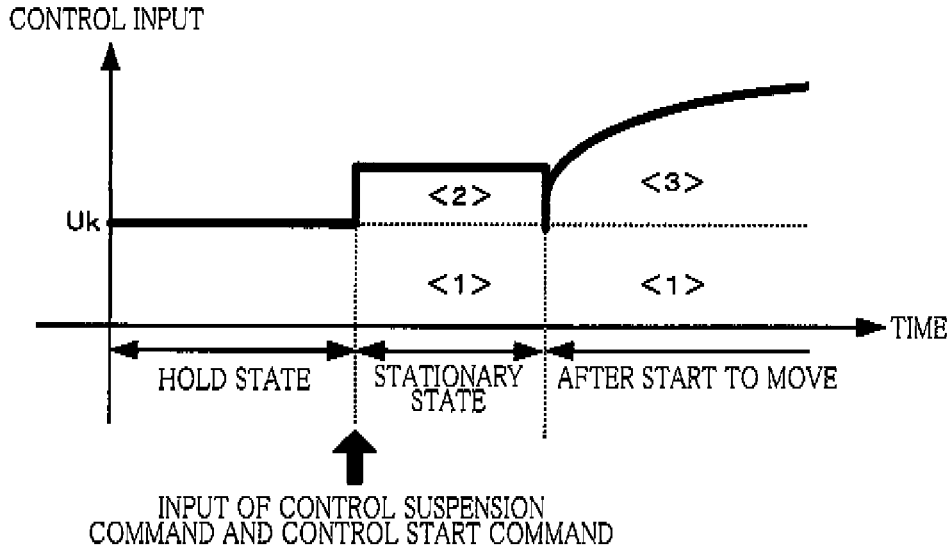

There will be next explained a fourth embodiment of the invention with reference to FIG. 10B. The graph of FIG. 10B shows a locus of the control input U set in the periodic processing according to the fourth embodiment. The signs <1>, <2>, <3> in FIG. 10B respectively correspond to the signs <1>, <2>, <3> in FIG. 6.

In the first embodiment where a negative judgment is made in S640, the addition value Ufb+Uk+Usf obtained by adding the hold control input Uk and the static friction compensation amount Usf to the feedback control input Ufb is set as the control input U (S650). In S650 in the present embodiment, an addition value Uk+Usf of the hold control input Uk as a first correction amount and the static friction compensation amount Usf as a second correction amount is set as the control input U, i.e., U=Uk+Usf. Where an affirmative judgment is made in S640, an addition value Ufb+Uk of the feedback control input Ufb as the main control input and the hold control input Uk is set as the control input U (S660).

Even where the control input U is set as described in the fourth embodiment explained above, the initial value of the control input U is set to be not smaller than the hold control input Uk. Accordingly, as in the first embodiment, it is possible to execute the sheet conveyance control while preventing the reverse rotation of the conveyance roller 201 that would cause retracting of the sheet P. In the present embodiment, however, there may exist a possibility that the conveyance roller 201 and the sheet P do not start moving at all if the static friction compensation amount Usf is small. In view of this, it is preferable that the static friction compensation amount Usf be set to a higher value.

In the example of FIG. 10B, the calculation of the feedback control input Ufb is executed from the time point when the conveyance roller 201 and the sheet P have started moving. The feedback control input Ufb may be calculated before the conveyance roller 201 and the sheet P start moving, and the calculated feedback control input Ufb may be used after the conveyance roller 201 and the sheet P have started moving. That is, the feedback control input Ufb may be calculated starting from one of a time point when it has been judged that a prescribed condition is satisfied; and any time point before the prescribed condition is satisfied after the motor control processing has been started.

Where the calculation of the feedback control input Ufb is executed from the time point when the conveyance roller 201 and the sheet P have started moving as shown in FIG. 10B, the periodic processing may be configured such that the feedback control input Ufb is set at zero until the conveyance roller 201 and the sheet P start moving, without executing the processing in S620, S630 and such that the processing in S620, S630 is executed after the conveyance roller 201 and the sheet P have started moving. Further, the periodic processing may be configured such that in S620, the target position Xr used in the calculation of the deviation e is determined not on the basis of the time t from the time point when the control start command is inputted, but on the basis of a time t' from the time point when the conveyance roller 201 and the sheet P have started moving.

<Supplementary Explanation>

In the first through the fourth embodiments described above, the LF motor M2 and the sheet conveyor mechanism 20 corresponds to one example of a conveyor mechanism. The motor control portion 703 corresponds to one example of a controller. The PWM-signal generating portion 707 and the motor driver DR2 corresponds to one example of a motor drover. The encoder-signal processing portion 701 corresponds to one example of a detector. Each processing of the motor control portion 703 by the input of the control suspension command corresponds to one example of a motor control processing for each sheet conveyance operation. The feedback control input Ufb corresponds to one example of a main control input. A portion of the motor control portion 703 that executes the processing in S640 corresponds to one example of a judging device.

There have been explained the embodiments of the present invention. It is to be understood that the invention is not limited to the details of the embodiments but may be embodied with other changes and modifications without departing from the scope of the invention defined in the attached claims. For instance, the present invention may be applicable to image forming apparatus other than the ink-jet printer.

What is claimed is:

1. An image forming apparatus configured to form an image on a sheet by a sheet conveyance operation in which the sheet is conveyed and an image forming operation in which the image is formed on the sheet that is at rest, the sheet conveyance operation and the image forming operation being repeated alternately a plurality times, comprising:

a conveyor mechanism having a motor and configured to convey the sheet by a driving force of the motor;

a motor driver configured to drive the motor; and a controller configured to implement a control relating to the sheet conveyance operation by execution of motor control processing in which a control input with respect to the motor is calculated and a signal corresponding to the control input is inputted to the motor driver, wherein the controller implements the motor control processing in each sheet conveyance operation such that the control input is repeatedly calculated for permitting the sheet to be conveyed to a target stop position correspond to a current sheet conveyance operation and for keeping the sheet located at the target stop position and such that the signal corresponding to the calculated control input is repeatedly inputted to the motor driver, and wherein, in the motor control processing, the controller calculates the control input such that, after the sheet has reached the target stop position, the control input is equal to a hold control input required for permitting the sheet to be kept located at the target stop position and such that, at a start point of the motor control processing, the control input is not smaller than the hold control input in the motor control processing in a previous sheet conveyance operation.

2. The image forming apparatus according to claim 1, further comprising a detector configured to detect a sheet position that is a position of the sheet, wherein, in the motor control processing, the controller calculates the control input utilizing a technique of a feedback control based on the sheet position detected by the detector and the controller continues calculating the control input even after the sheet has reached the target stop position, whereby the controller calculates the hold control input as the control input after reaching of the sheet to the target stop position.

3. The image forming apparatus according to claim 2, wherein, in the motor control processing, the controller calculates the control input at the start point of the motor control processing so as to be not smaller than the latest control input calculated in the motor control processing in the previous sheet conveyance operation or corresponding to the signal inputted to the motor driver in the motor control processing in the previous sheet conveyance operation.

4. The image forming apparatus according to claim 1, wherein, in the motor control processing, the controller sets a target locus that defines a change of a target position until reaching the target stop position, the controller successively calculates a main control input as one component of the control input on the basis of the target position according to the target locus, and the controller successively calculates the control input on the basis of the calculated main control input.

5. The image forming apparatus according to claim 4, further comprising a detector configured to detect a sheet position that is a position of the sheet, wherein, in the motor control processing, the controller repeatedly calculates the main control input utilizing a technique of a feedback control based on a deviation of the sheet position detected by the detector from the target position according to the target locus.

6. The image forming apparatus according to claim 5, wherein, in the motor control processing, the controller calculates the main control input from the start point of the motor control processing.

7. The image forming apparatus according to claim 6, wherein, in the motor control processing, the controller sets a correction amount that is not smaller than the hold control input and calculates, as the control input, an addition value of the main control input and the correction amount at least at the start point of the motor control processing.

8. The image forming apparatus according to claim 7, wherein, in the motor control processing, the controller calculates, as the control input, the addition value of the main control input and the correction amount during a time period between the start point and an end point of the motor control processing.

9. The image forming apparatus according to claim 7, wherein, in the motor control processing, the controller changes a value of the correction amount such that the value of the correction amount until it is judged that a prescribed condition is satisfied from the start point of the motor control processing and the value of the correction amount after it has been judged that the prescribed condition is satisfied are mutually different.

10. The image forming apparatus according to claim 9, wherein, in the motor control processing, the controller judges that the prescribed condition is satisfied where the sheet has started to move, and the controller changes the value of the correction amount such that the value of the correction amount until the sheet starts to move from the start point of the motor control processing and the value of the correction amount after the sheet has started to move are mutually different.

11. The image forming apparatus according to claim 10, wherein, in the motor control processing, the controller sets the correction amount at an addition value of the hold control input and a control input corresponding to a force necessary for the sheet to overcome a static friction force acting thereon so as to start to move, until the sheet starts to move from the start point of the motor control processing, and the controller calculates the correction amount as the control input after the sheet has started to move.

12. The image forming apparatus according to claim 7, wherein, in the motor control processing, the controller calculates, as the control input, the addition value of the main control input and the correction amount until it is judged that a prescribed condition is satisfied from the start point of the motor control processing, and the controller calculates the main control input as the control input after it has been judged that the prescribed condition is satisfied.

13. The image forming apparatus according to claim 12, wherein, in the motor control processing, the controller judges that the prescribed condition is satisfied where the sheet has started to move, and the controller calculates, as the control input, the addition value of the main control input and the correction amount until the sheet starts to move from the start point of the motor control processing, and the controller calculates the main control input as the control input after the sheet has started to move.

14. The image forming apparatus according to claim 6, wherein, in the motor control processing, the controller sets a correction amount that is not smaller than the hold control input, the controller calculates the correction amount as the control input until the main control input exceeds the hold control input from the start point of the motor control processing, and the controller calculates the main control input as the control input after the main control input has exceeded the hold control input.

15. The image forming apparatus according to claim 14, wherein, in the motor control processing, the controller sets the correction amount as the hold control input.

16. The image forming apparatus according to claim 5, wherein, in the motor control processing, the controller sets a first correction amount that is not smaller than the hold control input and a second correction amount different from the first correction amount, and the controller calculates the main control input starting from one of a time point when it has been judged that a prescribed condition is satisfied; and any time point before the prescribed condition is satisfied after the motor control processing has been started, and wherein, in the motor control processing, the controller calculates, as the control input, an addition value of the first correction amount and the second correction amount until the prescribed condition is satisfied from the start point of the motor control processing, and the controller calculates, as the control input, an addition value of the first correction amount and the main control input after the prescribed condition has been satisfied.

17. The image forming apparatus according to claim 16, wherein, in the motor control processing, the controller judges that the prescribed condition is satisfied where the sheet has started to move, and the controller calculates, as the control input, an addition value of the hold control input as the first correction amount and a control input, as the second correction amount, corresponding to a force necessary for the sheet to overcome a static friction force acting thereon so as to start to move, until the sheet starts to move from the start point of in the motor control processing, and the controller calculates, as the control input, an addition value of the hold control input as the first correction amount and the main control input after the sheet has started to move.

* * * * *